US005722925A

United States Patent [19]

Kameyama et al.

[11] Patent Number: 5,722,925

[45] Date of Patent: Mar. 3, 1998

[54] ELECTRICAL FEMALE TERMINAL WITH LOCK MECHANISM

[75] Inventors: Isao Kameyama; Shigeru Tanaka, both of Shizuoka, Japan

[73] Assignee: Yazaki Corporation, Tokyo, Japan

[21] Appl. No.: 669,726

[22] Filed: Jun. 26, 1996

[30] Foreign Application Priority Data

Jun. 28, 1995 [JP] Japan ..... 7-161981

[51] Int. Cl.[6] ..... H01R 11/22

[52] U.S. Cl. ..... 493/849; 493/851; 493/852

[58] Field of Search ..... 439/843–847, 439/848, 849, 850, 851, 852, 862

[56] References Cited

U.S. PATENT DOCUMENTS

| | | | |
|---|---|---|---|
| Re. 30,277 | 5/1980 | Simmons . | |
| Re. 31,142 | 2/1983 | Simmons . | |
| 3,976,348 | 8/1976 | Simmons . | |
| 4,167,299 | 9/1979 | Noguchi . | |
| 4,550,963 | 11/1985 | Moors | 439/845 |
| 4,558,913 | 12/1985 | Goto et al. | 439/849 |
| 4,717,356 | 1/1988 | Rahrig et al. | 439/852 |
| 4,934,966 | 6/1990 | D'Urso | 439/849 |
| 5,350,321 | 9/1994 | Takenouchi | 439/851 |
| 5,593,328 | 1/1997 | Okada et al. | 439/851 |

FOREIGN PATENT DOCUMENTS

| | | |
|---|---|---|
| 57-84675 | 5/1982 | Japan . |
| 58-212081 | 12/1983 | Japan . |
| 59-177188 | 11/1984 | Japan . |
| 61-4176 | 1/1986 | Japan . |
| 2-40872 | 2/1990 | Japan . |
| 2-148571 | 12/1990 | Japan . |
| 3-133072 | 6/1991 | Japan . |

*Primary Examiner*—J. J. Swann

*Attorney, Agent, or Firm*—Finnegan, Henderson, Farabow, Garrow & Dunner, L.L.P.

[57] ABSTRACT

A male terminal receiving portion formed in a channel shape or in a box frame shape is composed of a base plate, each side wall, and an upper plate that are formed by cutting and bending an electrically conductive plate. An elastic contact member is provided in the male terminal receiving portion and integrally turns back from the fore end of the base plate. A lock portion and engaging with the male terminal is provided in the elastic contact member. The elastic contact member has a folded-back portion extending from the fore end of the base plate.

7 Claims, 6 Drawing Sheets

ELECTRICAL FEMALE TERMINAL WITH LOCK MECHANISM

BACKGROUND OF THE INVENTION

1. Field of the Invention

This invention relates to an electrical female terminal with a lock mechanism, particularly to a female terminal making an improved dependable electrical connection with a corresponding male terminal.

2. Description of the Prior Art

In the connection of male and female terminals, lock mechanisms are known for securing the connection thereof and for eliminating the unintentional disengagement of the terminals.

FIGS. 7 and 8 show such a female terminal with a lock mechanism disclosed in Japan patent application laid-open No. 58-212081.

In the Figures, the component designated A is a female terminal having a male terminal receiving portion A1 in its fore part and a wire connection portion A2 in its rear part. The male terminal receiving portion A1 is shaped in channel-like form by bending an electrical conductive plate, being composed of a base plate a, each side wall b, b and each upper plate c, c extended from the upper edge of each side wall b toward each other opposing side wall b. The male terminal receiving portion A1 has an elastic tongue d integrally turning back from the fore end of the base plate a. The elastic tongue d is separated into three members by way of a couple of slits, each member of which extending backwardly in the male terminal receiving portion A1. The middle member of the separated elastic tongue d constitutes an elastic contact member d1 extending substantially parallel with the base plate a and formed with a lance e in a middle portion thereof to serve as a lock portion. A free end of the elastic contact member d1 forms an upwardly bent, rising member f. Meanwhile, each press-contacting member d2, d2 provided in each side portion of the elastic tongue d is bent into a ramp shape and the tip g of the press-contacting member d2 resiliently abuts against the base plate a.

A male terminal B, as shown in FIG. 8, is inserted between the upper plates c, c and the elastic tongue d of the female terminal A received in the connector housing C. When the male terminal B has advanced to a predetermined position, the lance e of the elastic contact member d1 engages with a hole h cut out in the male terminal B to serve as a lock mechanism, which locks the male terminal B to the female terminal A. The male terminal B is pressed by and makes electrical connection with the elastic contact member d1 and the upper plates c, c by the elastic force of the elastic contact member d1 and the resilient force of the press-contacting member d2. The fore end g of the press-contacting member d2 is forced to abut against the base plate a, which provides a sufficient contact pressure to the male terminal B.

The lock mechanism can be released by pushing downwardly the rising member f formed in the free end of the elastic contact member d1 by a lever i, which disengages the lance e from the hole h of the male terminal B. Then, drawing out the male terminal B or the connector housing C in the opposite direction of the engagement releases the engagement of the female terminal A and the male terminal B.

However, in the aforementioned prior art, in disengagement of the female terminal A and the male terminal B, the male terminal B or the connector housing C may be unintentionally drawn out in the opposite direction to the engagement without releasing the lock mechanism between the male and female terminals. This causes that a tensile force F applied to the male terminal B directly acts on the elastic contact member d1 of the female terminal A. Accordingly, as shown in FIG. 9A, a turned-back base portion r of the elastic contact member d1 receives a concentrated stress. Thereby, as shown in FIG. 9B, there may be a deformation or a buckling in a curved portion r' of the elastic contact member d1, resulting in a drawback that the elastic contact member d1 abuts against the male terminal B with a reduced elastic press-contacting force to cause unstable electrical connection.

SUMMARY OF THE INVENTION

In view of the above-mentioned drawback, an object of this invention is to provide a female terminal with a lock mechanism that realizes a stable electrical connection without an easy deformation or buckling in the curved portion, even when the male terminal or the connector housing may be unintentionally drawn out in the opposite direction to the engagement without releasing the lock mechanism between the male and female terminals.

For achieving the object, the present invention provides a female terminal with a lock mechanism including;

a male terminal receiving portion formed in a channel shape or in a box frame shape, the male terminal receiving portion being composed of a base plate, each side wall, and an upper plate that are formed by cutting and bending one electrically conductive plate, an elastic contact member provided in the male terminal receiving portion and integrally turned back from the fore end of the base plate a to extend rearward, and a lock portion provided in the elastic contact member and engaging with the male terminal, wherein the elastic contact member has a folded-back portion integrally extending from the fore end of the base plate.

Referring to an effect of the present invention, the elastic contact member has the folded-back portion turned back from the base plate and a contact portion further extending from the folded-back portion. That is, the contact portion is not directly turned back from the base plate, which is differed from the prior art. Thereby, even if unintentional drawing-out force acts on the elastic contact member, as shown in FIG. 9B, the stress is distributed in the whole folded-back portion, resulting in that the elastic contact member does not easily deform or buckle and provides a stable electrical connection.

DETAILED DESCRIPTION OF PREFERRED EMBODIMENTS

Figure 1:
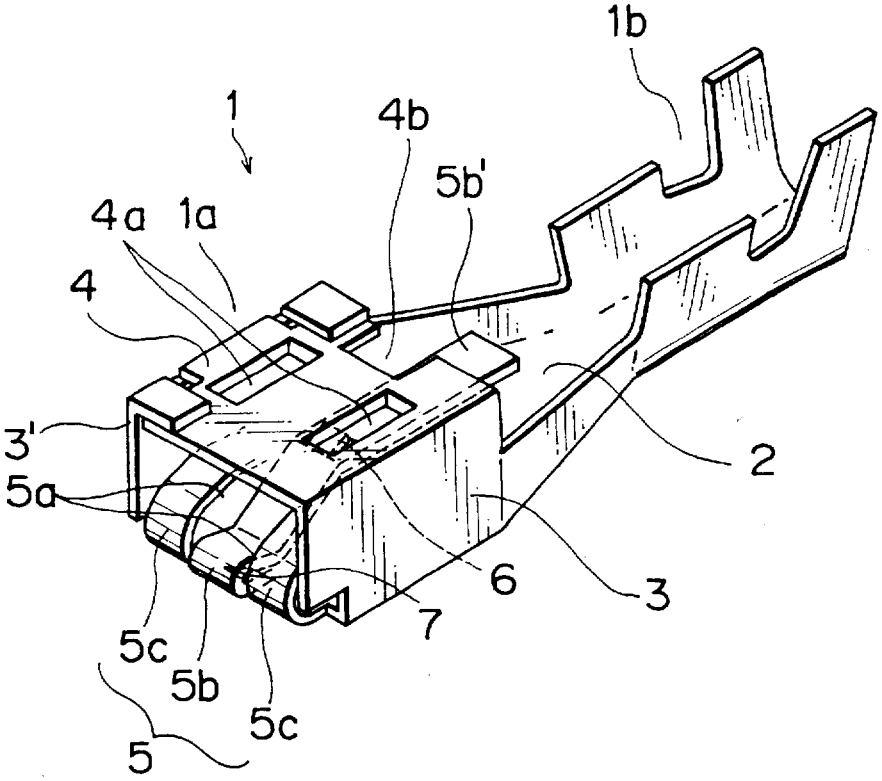
FIG. 1 is a perspective view of a female terminal with a lock mechanism according to the present invention.

Next, an embodiment of the present invention will be discussed with reference to FIGS. 1 to 4.

In these Figures, a female terminal 1 is formed by cutting and bending one electrically conductive plate. The female terminal 1 has a base plate 2, in the fore part of which there is formed a male terminal receiving portion 1*a*, and in the rear part of which there is formed a wire connection portion 1*b*. The male terminal receiving portion 1*a* is shaped in a box frame, being composed of the base plate 2, each side wall 3, 3', and an upper plate 4. The upper plate 4 is formed by bending an extended portion of one side wall 3 to reach to the other side wall 3'. The upper plate 4 is formed with a couple of embossed portions 4*a*, 4*a* inwardly struck out into the male terminal receiving portion 1*a*.

Besides, in the same way as the prior art, upper plates 4, 4 may be formed by inwardly bending each of right and left side walls 3, 3' with a space therebetween so that the male terminal receiving portion 1*a* is formed in the shape of a channel frame.

An forwardly extended portion of the base plate 2 is turned back to form an elastic tongue member 5. The elastic tongue member 5 is separated into three members composing of a middle elastic contact member 5*b* and press-contacting members 5*c*, 5*c* located at each side of the middle elastic contact member 5*b* by way of a couple of slits 5*a*, 5*a*. The middle elastic contact member 5*b* extends substantially parallel to the base plate 2 and is formed with a struck-out lance 6 in the middle thereof to serve as a lock projection. A free end portion 5*b*' of the elastic contact member 5*b* extends backwardly beyond the rear end of the male terminal receiving portion 1*a*, that is, from a recess 4*b* formed in the rear end portion of the upper plate 4. Preferably, the elastic contact member 5*b* is compensated by downwardly bending each side edge to configure U-shape in section. Meanwhile, each of press-contacting members 5*c*, 5*c* provided in each side of the elastic contact member 5*b* is bent in a ramp shape and the tip of the press-contacting member 5*c* resiliently abuts against the base plate 2.

In the above-mentioned embodiment, the elastic tongue member 5 has been separated into the elastic contact member 5*b* and the press-contacting members 5*c*, 5*c* by way of the slits 5*a*, 5*a*. However, the elastic tongue member 5 with no slit may be utilized only as the elastic contact member 5*b*.

Further, the base plate 2 is formed with a lock hole 2*a* and a support piece 2*b* by partially cutting out and rising up a portion of the base plate Z under the elastic contact member 5*b*.

The lock hole 2*a* engages with a flexible lock arm provided in an under-mentioned connector housing to prevent backward disengagement of the female terminal 1. Meanwhile, the tip of the support piece 2*b* spaces a little from the elastic contact member 5*b*. This prevents the elastic contact member 5*b* from deflecting beyond its elastic limit.

The above-mentioned construction of the female terminal 1 is substantially the same as the prior art. However, in the present invention, the middle elastic contact member 5*b* of the elastic tongue member 5 is not turned back directly from the upper plate 4, but by way of a combined folded-back portion 7. That is, the folded-back portion 7 is integrally composed of an extended piece 7*a* extending from the fore end of the base plate 2, a curved piece 7*b* with a small curvature radius extending from the extended piece 7*a*, a folded-back upper piece 7*c* backwardly extending from the curved piece 7*b* close to the extended piece 7*a*. Further, the elastic contact piece 5*b* extends parallel to the base plate 2 by way of a sloping piece portion 5*b*" slantingly rising from the rear end the backwardly extending 7*c*. Preferably, a rising base point R' of the sloping piece portion 5*b*" (that is, an intersecting point of the sloping piece portion 5*b*" and the folded-back upper piece 7*c*) positions rearward in comparison with a folding base point R of the extended piece 7*a*.

Figure 5:
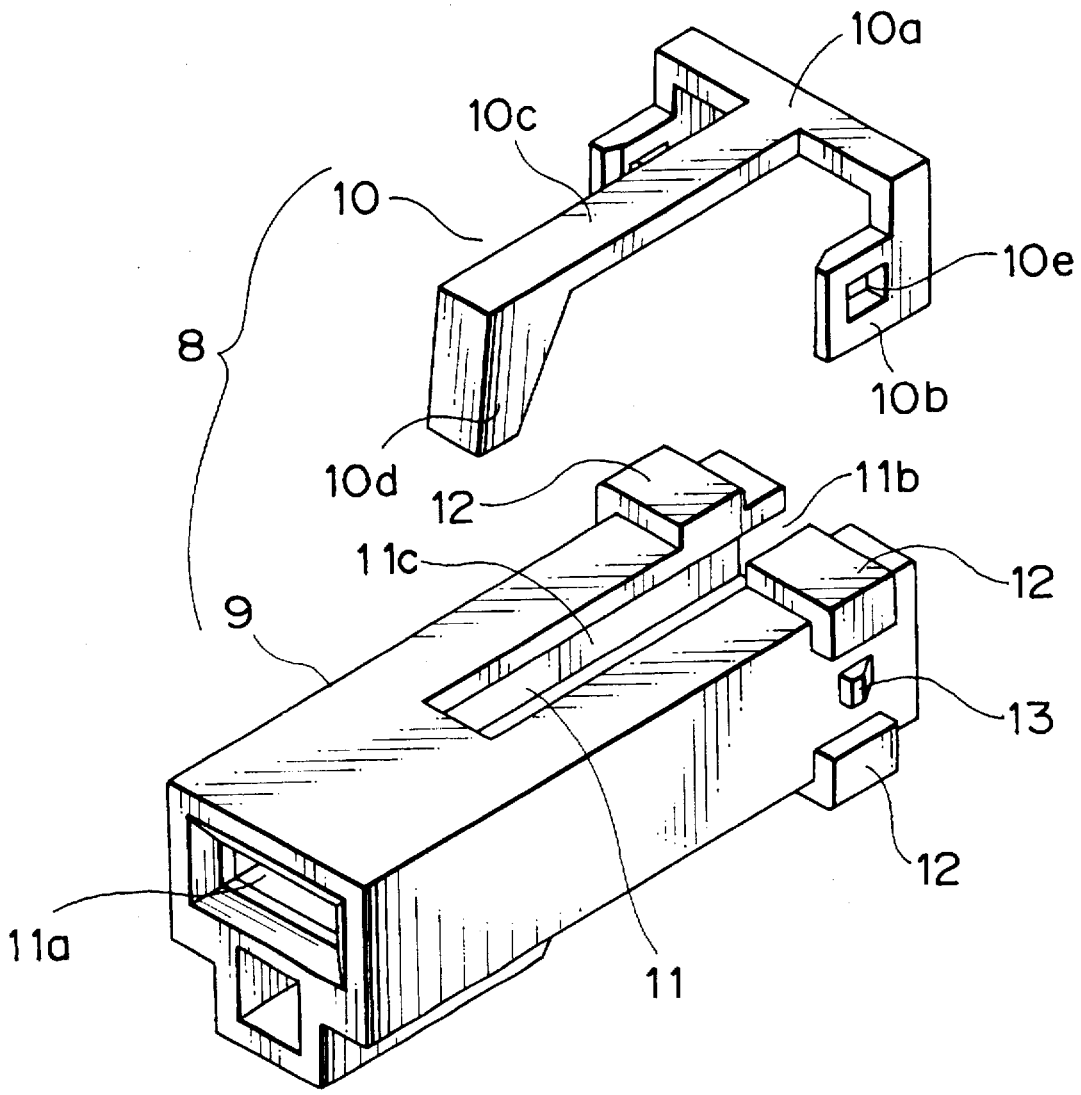
FIG. 5 is an exploded perspective view of a connector housing receiving the female terminal according to the present invention.

FIG. 5 shows a connector housing 8 receiving the female terminal 1. The connector housing 8 is composed of a main body 9 and a releasing lever 10 constituting another body. The main body 9 has a terminal receiving chamber 11 therein, the terminal receiving chamber 11 including a forward insertion opening 11*a* and a rearward female terminal insertion opening 11*b*. In an upper wall of the main body 9, an opening 11*c* of the terminal receiving chamber 11 extends from the middle of and up to the rear end of the upper wall. The opening 11*c* connects, at the rear end thereof, to the female terminal insertion opening 11*b*. Around the female terminal insertion opening 11*b* of the main body 9, a stop 12 is formed on the upper wall and each side wall of the main body 9. A middle portion of the stop 12 in each of the side walls is cut off and is provided with a locking projection 13.

The releasing lever 10 is composed of a U-shaped base portion 10*a* abutting against the stop 12, a locking portion 10*b* formed in each end of the U-shaped base portion 10*a*, an operating portion 10*c* inserted into the opening 11*c* of the main body 9 orthogonally to the base portion 10*a*, and pushing portion 10*d* formed in the fore end portion of the operating portion 10*c*.

The releasing lever 10 is inserted downwardly or forwardly into the main body 9 of the connector housing. The locking portion 10*b* rides over the locking projection 13, so that the hole 10*e* of the locking portion 10*b* engages with the locking projection 13. Simultaneously, the fore end of the U-shaped base portion 10*a* abuts against the rear surface of the stop 12 to position the releasing lever 10 just there. In this stage, the pushing portion 10*d* of the releasing lever 10 has inserted the head thereof in the terminal receiving chamber 11.

Figure 6:
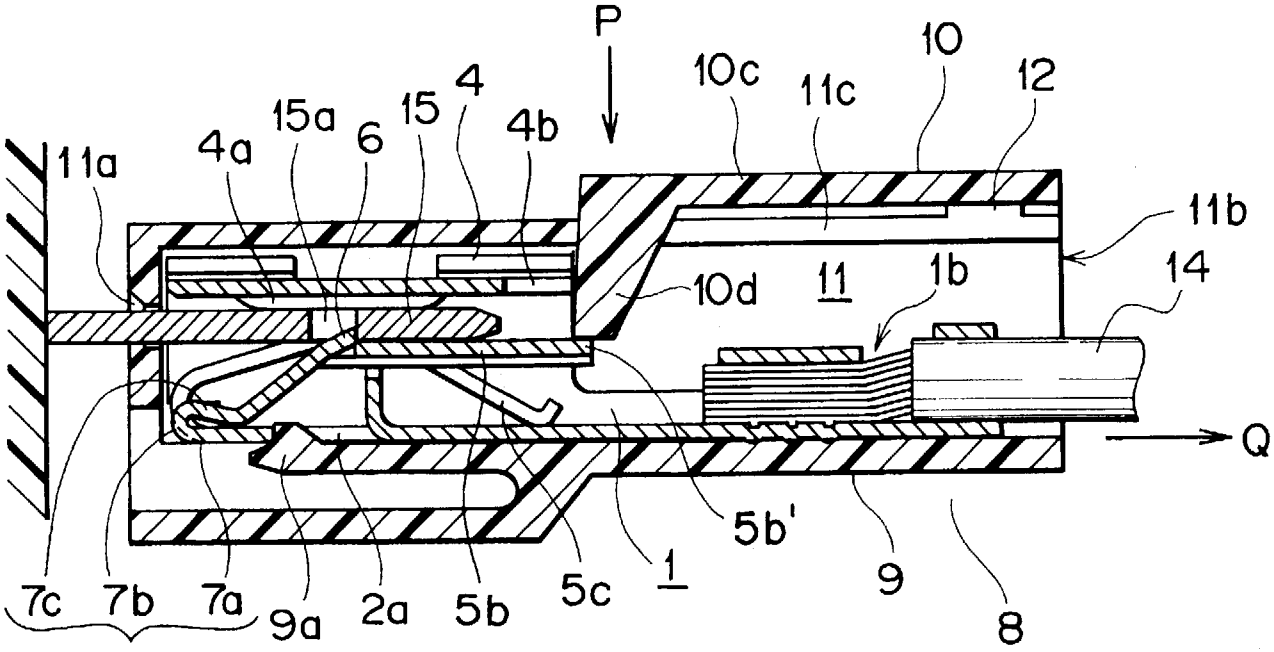
FIG. 6 is a sectional view showing an utilized state of the female terminal according to the present invention.
Figure 7:
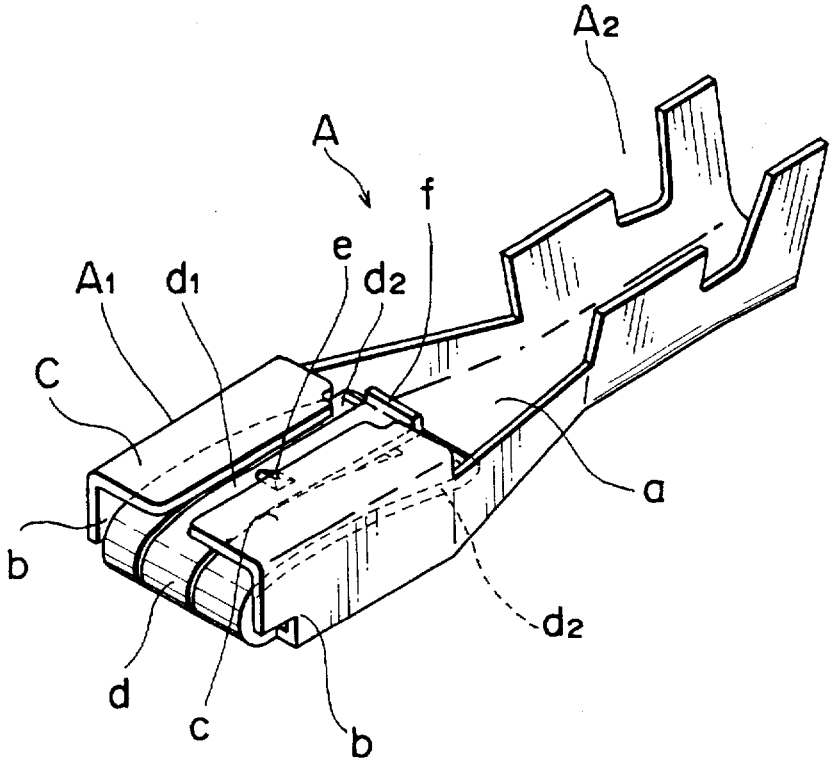
FIG. 7 PRIOR ART
FIG. 7 is a perspective view a female terminal with a lock mechanism in a prior art.
Figure 8:
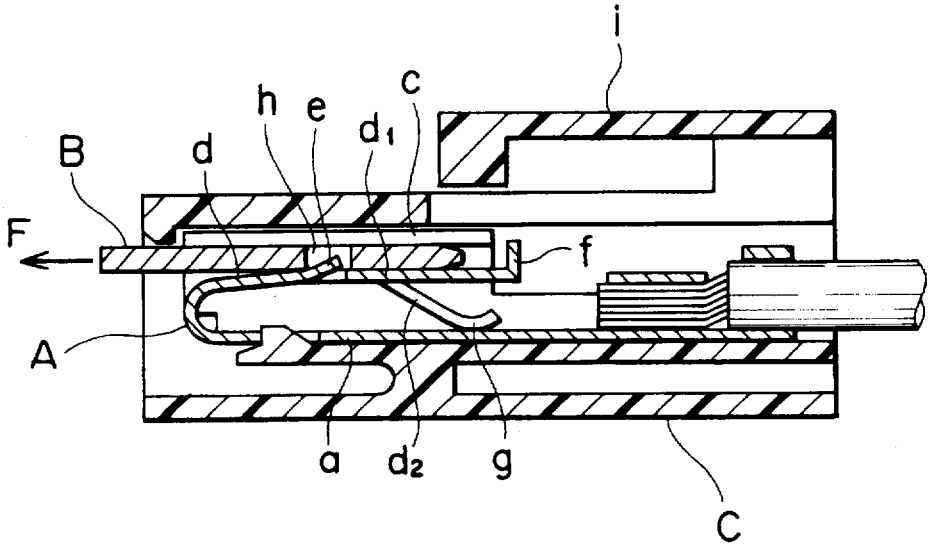
FIG. 8 PRIOR ART
FIG. 8 is a sectional view showing a utilized state of the female terminal in the prior art.

FIG. 6 is a view showing a utilized state of a female terminal according to this invention. The female terminal 1 has connected to an electrical wire 14 at the wire connection portion 1*b* at the rear end thereof, has been inserted into the housing main body 9, and has engaged with the male terminal 15.

First, assembling of the connector will be discussed hereinafter. In the connector housing main body 9, the releasing lever 10 is mounted precedently. The female terminal 1 inserted from the female terminal insertion opening 11*b* positioned in the rear portion of the main body 9 firstly abuts against a rear slant surface of the pushing portion 10*d*. Then, the female terminal 1 slides along the slant surface and advances forward with upwardly bending the pushing portion 10*d* and the operating portion 10*c* together and with riding on the flexible locking arm 9*a* arranged in the main body 9. Next, the flexible locking arm 9a engages with the lock hole 2a so that the female terminal 1 is securely locked in the main body 9 at a predetermined position. The pushing portion 10d engages with the recess 4b positioned in the rear end of the upper plate 4 by the resiliency of the operating portion 10c, so that the operating portion 10c returns to its flat state. Thereby, the assembling of the connector has been completed.

Besides, the releasing lever 10 may be attached to the connector housing main body 9, after the female terminal 1 has been mounted.

Further, the male terminal 15 is inserted from the insertion opening 11a of the connector housing 8 to be received in the male terminal receiving portion 1a of the female terminal 1. The male terminal 15 reaches between the embossed portion 4a formed in the upper plate 4 and the elastic contact member 5b, and then, the struck-out lance 6 engages with a hole 15a of the male terminal 15 so that the female terminal 1 and the male terminal 15 are locked to each other. The male terminal 15 is forced to abut against and connects electrically with the embossed portion 4a by the elastic force of the elastic contact member 5b and the resilient force of the press-contacting members 5c, 5c of which the tips are forced to abut against the base plate 2, which provides a sufficient contact force.

Next, the disengagement process of the female terminal 1 and the male terminal 15 will be discussed. In the engaging state shown in FIG. 6, a force P oriented by an arrow head acts on the pushing portion 10d in the fore end portion of the releasing lever 10. Thereby, the free end portion 5b' of the elastic contact member 5b moves downward, so that the struck-out lance 6 disengages from the hole 15a of the male terminal 15 to release the locking between the female terminal 1 and the male terminal 15. Then, by a force Q shown by an arrow head and acting on the connector housing 8 (or a force acting on the male terminal 15 in the opposite direction to the arrow head) can release the engagement of the female terminal 1 and the male terminal 15.

In the disengagement of the female terminal 1 and the male terminal 15, if the connector housing 8 is drawn to be disengaged from the male terminal 15 without the above-mentioned lock releasing operation, a tensile force in the opposite direction to the arrow head Q acts on the elastic contact member 5b.

Figure 2:
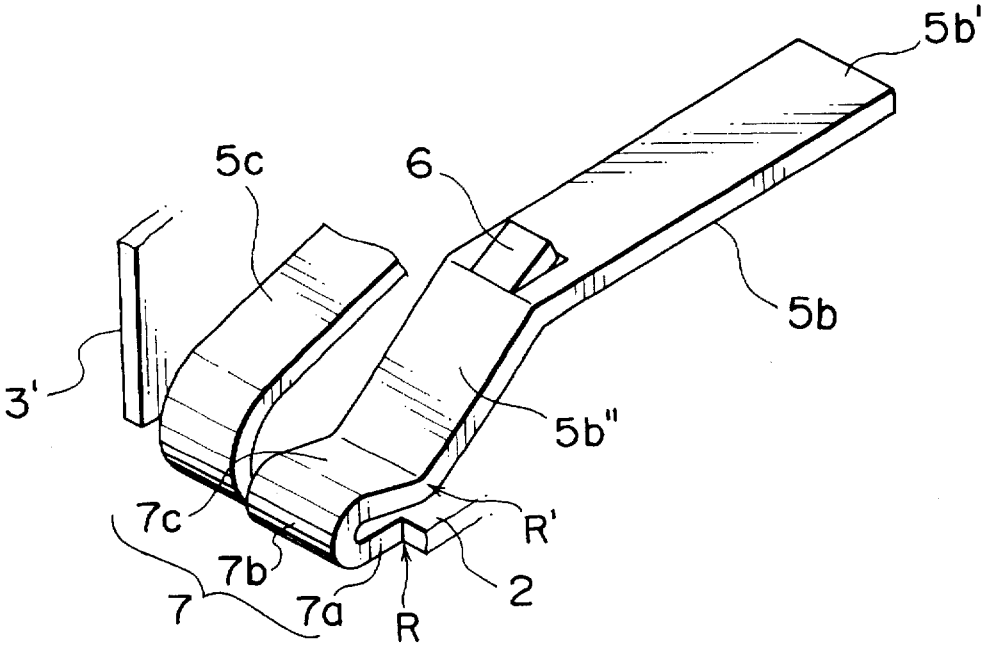
FIG. 2 is a partial enlarged perspective view of the female terminal in FIG. 1.
Figure 3:
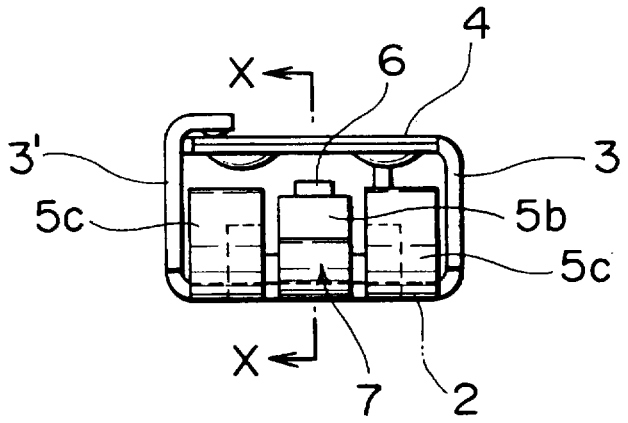
FIG. 3 is the front view of the female terminal with the lock mechanism in FIG. 1.
Figure 4:
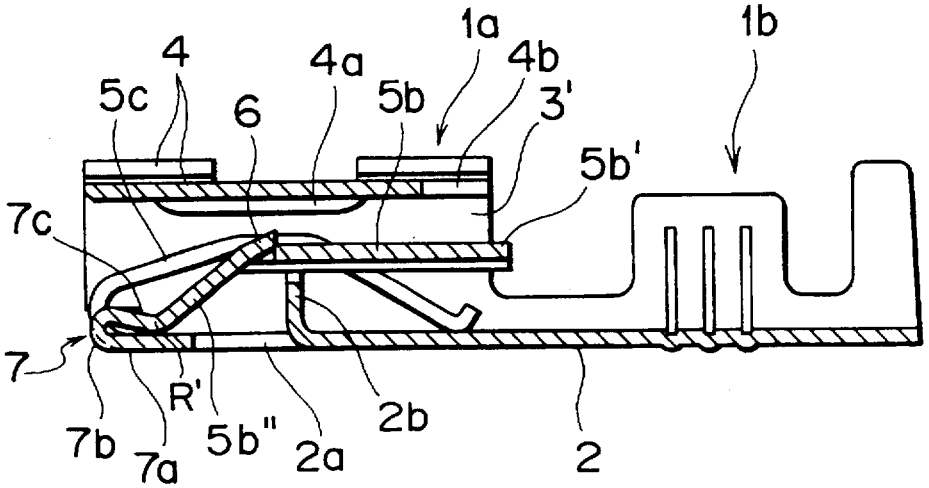
FIG. 4 is a sectional view taken along a line X—X in FIG. 3.
Figure 9A:
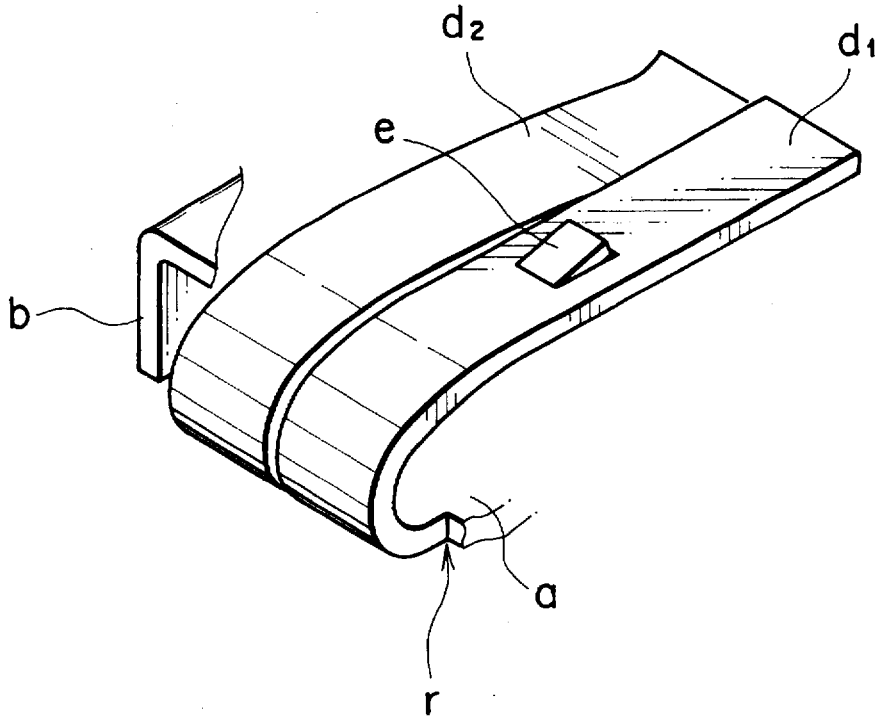
FIG. 9A PRIOR ART
FIG. 9A is a partial enlarged perspective view of the female terminal in the prior art.
Figure 9B:
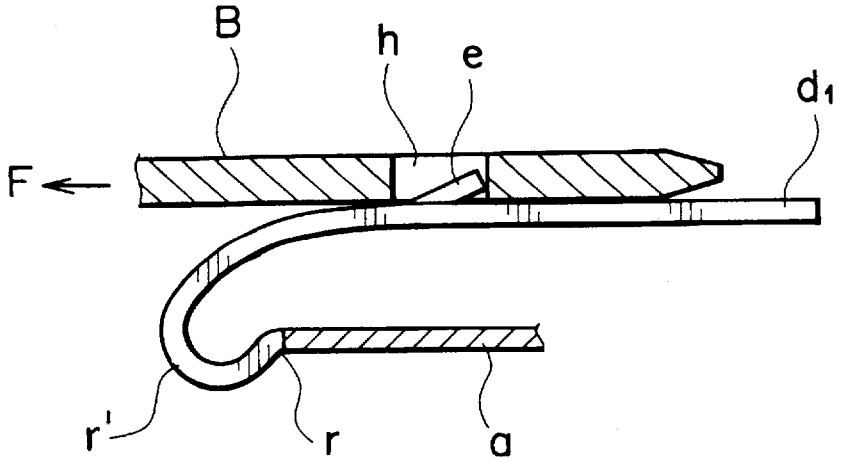
FIG. 9B PRIOR ART
FIG. 9B is an explanatory illustration of the same.

In this case, turning torque acted on the elastic contact member 5b by the male terminal 15 is substantially distributively resisted by the three portions respectively including the support points that are the rising base point R' of the sloping member portion 5b", the curved piece 7b of the folded-back portion 7, and the folding base portion R (refer to FIG. 2). Therefore, unlike the prior art shown in FIG. 9A, the tensile force is not concentrated only in the folding base portion R but can be broadly distributed in the backwardly extending piece 7c, the curved piece 7b, and the extended piece 7a, resulting in an increased resisting strength of the female terminal 1. Particularly, where the rising base point R' positions rearward to the folding base portion R, a further increased resisting strength may be expected. Accordingly, the elastic contact member 5b may not be easily deformed or buckled, which provides a stable electrical connection.

As discussed above, according to the present invention, even if a disengaging tensile force acts between the female terminal and the male terminal with the state that the female terminal has been locked to the male terminal, the female terminal does not receive a locally concentrated stress and does not easily deform or buckle, resulting in improved reliable electrical connection between the female terminal and the male terminal.

What is claimed is:

1. A female terminal with a lock mechanism comprising: a male terminal receiving component having a base plate including front and back ends, side walls, and an upper plate formed of one electrically conductive plate, an elastic contact member in said male terminal receiving portion and turned back from a front end of said base plate to extend backwardly, and a lock portion provided in said elastic contact member and engageable with a male terminal, wherein said elastic contact member has an extended portion extending forwardly from the front end of said base plate, a curved portion extending backwardly from the extended portion, a sloping portion reclined from a back end of said curved portion, and a contact portion extending backwardly from the sloping portion in parallel with said base plate, the sloping portion and curved portion intersecting backwardly of an intersection of said base plate and said extended portion.

2. A female terminal as claimed in claim 1, wherein said lock portion has a lance struck out from said contact portion in said elastic contact member for engaging with a complementary hole of the male terminal.

3. A female terminal as claimed in claim 1, wherein said female terminal has a support inwardly struck out from said base plate and standing up below said elastic contact member, a top of said support being positioned with a space that prevents said elastic contact member from deflecting beyond its elastic limit.

4. A female terminal with a lock mechanism comprising:

a male terminal receiving component having a base plate including front and back ends, side walls, and an upper plate;

an elastic contact member provided in the male terminal receiving component and folded back from the front end of the base plate to extend backwardly, the elastic contact member being separated into a central elastic contact member and side press-contacting members by slits;

a lock portion in the central elastic contact member and engageable with a male terminal;

the central elastic contact member having an extended portion extending frontwardly from the front end of the base plate, a curved portion extending backwardly from the extended portion, a sloping portion reclined from a back end of the curved portion, and a contact portion backwardly extending from the sloping portion in parallel with the base plate;

the sloping portion and curved portion intersect backwardly of an intersection of the base plate and the extended portion.

5. A female terminal as claimed in claim 4, wherein said upper plate has an inwardly embossing portion spaced above said each side press-contacting member.

6. A female terminal as claimed in claim 4, wherein said central elastic contact member has downwardly bent side edge portions.

7. A female terminal as claimed in claim 4, wherein said female terminal has a support piece inwardly struck out from said base plate and standing up below said elastic contact member, a top of said support piece being positioned with a space that prevents said central elastic contact piece from deflecting beyond its elastic limit.

* * * * *